US011352191B2

(12) United States Patent
Buhl et al.

(10) Patent No.: US 11,352,191 B2
(45) Date of Patent: Jun. 7, 2022

(54) PACKAGING FOR AN ARTICLE AND METHOD OF PACKAGING AN ARTICLE

(71) Applicants: Buhl-PaperForm GmbH, Burbach (DE); Schock GmbH, Regen (DE)

(72) Inventors: Christoph Buhl, Neunkirchen (DE); Gerrit Benjamin Schneeweiss, Hettenshausen (DE)

(73) Assignees: Buhl-PaperForm GmbH, Burbach (DE); Schock GmbH, Regen (DE)

( * ) Notice: Subject to any disclaimer, the term of this patent is extended or adjusted under 35 U.S.C. 154(b) by 0 days.

(21) Appl. No.: 16/948,262

(22) Filed: Sep. 10, 2020

(65) Prior Publication Data

US 2021/0078787 A1 Mar. 18, 2021

(30) Foreign Application Priority Data

Sep. 12, 2019 (DE) ..... 10 2019 124 602.4

(51) Int. Cl.
*B65D 81/113* (2006.01)
*B65D 5/50* (2006.01)
*B65D 81/05* (2006.01)

(52) U.S. Cl.
CPC ..... *B65D 81/113* (2013.01); *B65D 5/503* (2013.01); *B65D 81/058* (2013.01); *B65D 2585/30* (2013.01); *B65D 2585/642* (2013.01); *B65D 2585/645* (2013.01)

(58) Field of Classification Search
CPC B65D 81/113; B65D 5/503; B65D 2585/645; B65D 2585/642; B65D 2585/30; B65D 81/058
USPC ..... 206/586
See application file for complete search history.

(56) References Cited

U.S. PATENT DOCUMENTS 4,387,808 A * 6/1983 Dornbusch ..... B65D 5/503 206/432
4,398,212 A * 8/1983 Serry ..... B65D 85/68 206/320
4,911,300 A * 3/1990 Colonna ..... B65D 71/50 206/427

(Continued)

FOREIGN PATENT DOCUMENTS

CN 103359395 A 10/2013
CN 105416854 A 3/2016

(Continued)

*Primary Examiner* — J. Gregory Pickett
*Assistant Examiner* — Brijesh V. Patel
(74) *Attorney, Agent, or Firm* — Smartpat PLC

(57) ABSTRACT

A packaging for an object and a method of packaging the object are disclosed The packaging comprises a sealable outer box and at least one padded part for insertion into the interior of the outer box. The padded part comprises shaped cushioning parts on its periphery for supporting the padded part on the inside against the side walls of the outer box so as to be secured against displacement. The padded part also includes a recess for the precisely fitting accommodation of the packaged object. Finally, the packaging in accordance with the invention comprises a support insert that, together with the padded part, defines a packaging space for the packaged object within the outer box, wherein the support insert extends at a distance from the side walls of the outer box and forms at least part of a side wall of the packaging space.

20 Claims, 7 Drawing Sheets

(56) References Cited

U.S. PATENT DOCUMENTS 5,160,473 A * 11/1992 Bontrager ..... B65D 81/107 264/154
5,323,896 A * 6/1994 Jones ..... B65D 5/5028 206/223
5,366,080 A * 11/1994 Carstersen ..... B65D 81/113 206/523
5,398,808 A * 3/1995 Chen ..... B65D 5/5071 206/320
5,715,940 A 2/1998 Son
5,758,513 A * 6/1998 Smith ..... B65D 81/3823 62/457.5
5,996,798 A * 12/1999 Gessert ..... B65D 81/052 156/145
7,299,926 B2 * 11/2007 Russell ..... B65D 81/07 206/583
7,328,800 B2 * 2/2008 Koike ..... B65D 5/5088 206/521
7,588,148 B2 * 9/2009 Yang ..... B65D 5/509 206/592
7,591,373 B2 * 9/2009 Horiuchi ..... B65D 5/5035 53/445
7,748,539 B2 * 7/2010 Onda ..... H01L 21/67369 206/591
7,789,239 B2 * 9/2010 Juliano ..... B65D 81/05 206/564
7,810,639 B2 * 10/2010 Djulaini ..... B65D 85/38 206/307
8,215,484 B2 * 7/2012 Lim ..... B65D 81/058 206/320
8,240,469 B2 * 8/2012 Goda ..... B65D 19/20 206/386
8,251,220 B2 * 8/2012 Ting ..... B65D 25/103 206/521
8,424,335 B2 * 4/2013 Corder ..... A61J 1/165 62/371
8,439,197 B2 * 5/2013 Yajima ..... B65D 85/30 206/454
8,763,811 B2 * 7/2014 Lantz ..... B65D 81/3823 206/584
8,887,916 B2 * 11/2014 Gilfert ..... B65D 81/113 206/433
9,180,998 B2 * 11/2015 Banks ..... B65D 19/02
2002/0189970 A1 * 12/2002 Koike ..... B65D 81/133 206/592
2003/0209464 A1 * 11/2003 Otsuka ..... B65D 81/113 206/586
2005/0161366 A1 * 7/2005 Kobashi ..... B65D 5/5002 206/586
2008/0067096 A1 3/2008 Maruta
2008/0277312 A1 * 11/2008 Eren ..... B65D 5/509 206/523
2009/0065385 A1 * 3/2009 Kakuta ..... B65D 81/113 206/316.1
2011/0220543 A1 9/2011 Lim
2012/0097569 A1 4/2012 Murano et al.
2016/0196993 A1 * 7/2016 Nagashima ..... H01L 21/67386 206/710
2016/0368691 A1 * 12/2016 Meng ..... B65D 81/113
2020/0277099 A1 * 9/2020 Wenner ..... B65D 5/5052

FOREIGN PATENT DOCUMENTS

DE 69205816 12/1995
DE 19628660 A1 2/1997
DE 20109440 U1 10/2002
DE 202016101339 U1 * 5/2016 ..... B65D 81/05
EP 1600401 A1 11/2005
EP 1902962 A3 11/2008
EP 2208688 A1 7/2010
EP 3608257 A1 * 2/2020 ..... B65D 81/113
FR 2778391 A1 * 11/1999 ..... B27N 5/00
JP H1029684 A 2/1998
WO 2007013319 A1 2/2007

* cited by examiner

PACKAGING FOR AN ARTICLE AND METHOD OF PACKAGING AN ARTICLE

TECHNICAL FIELD

The disclosure relates to a packaging for an object and a method for packaging the object by the packaging. In principle, the packaging and the method for packaging are suitable for packaging any objects, but are particularly suitable for packaging fragile objects, for example those made of a composite material, in particular sinks.

BACKGROUND

In the prior art, packaging for any objects is known in principle, particularly in the form of boxes. Embedding objects to be packaged inside the box in cushioning materials is also known. Particularly if the cushioning materials comprise loose bulk material, it is not always guaranteed that the packaged object is kept in the middle within the box in order to maintain a certain safety distance from the walls of the box that protects the packaged object in case of an impact of the box.

Furthermore, it is known in the prior art to provide molded parts made of polystyrene as cushioning materials. Those clamp the packaged object, for example a television or a monitor, in the middle of a considerably larger box and bridge the distance between the packaged object and the inner sides of the box, so that the packaged object is immovable.

However, even such known packaging solutions are not optimal in terms of the safety of the packaged object, in particular if the box with the object falls to the ground. In this case, in particular those areas of the packaged object that are not covered by the cushioning material are largely unprotected—apart from the single-ply box. Also, the single-ply box typically offers only very limited inherent stability, in particular when subjected to shear forces, such as those that can occur when the box falls to the floor.

SUMMARY

The disclosure is based on the object of further developing a known packaging for an object along with a known method for packaging the object in such a manner that the inherent stability of the packaging is improved, in particular against shear forces that may arise. Thereby, the safety of the packaged object against the risk of breakage is significantly improved.

This object is achieved by the subject matter as claimed. The packaging comprises a sealable outer box having a bottom, side walls and a top. Furthermore, the packaging comprises at least one padded part for insertion into the interior of the outer box. The padded part has shaped cushioning parts on its periphery for supporting the padded part on the inside against the side walls of the outer box so as to be secured against displacement. The padded part has a recess for precisely fitting accommodation of the packaged object. Furthermore, the packaging has at least one support insert that, together with the at least one padded part, defines a packaging space for the packaged object within the outer box. The support insert extends at a distance from the side walls of the outer box and forms at least part of a side wall of the packaging space.

Due to the precisely fitting design of the recess within the padded part to accommodate the packaged object, this is advantageously fixed relative to the padded part. In addition, the precisely fitting design of the at least one padded part to the internal dimensions of the outer box advantageously ensures that the packaged object, when it is mounted in the recess of the padded part so as to be secured against displacement, can no longer be displaced relative to the outer box; at least not in the plane in which the padded part extends. The shaped cushioning parts formed on the periphery of at least one padded part offer the advantage that they can absorb any impacts acting on the outer box from the outside, without the application of forces caused by the impacts reaching the packaged object. The support insert serves to stabilize the entire packaging, in particular in a direction perpendicular to the plane in which the padded part extends. Together with the padded part, the support insert forms a packaging space for the packaged object within the outer box. Together with the outer box, the specified packaging space provides double-walled protection for the packaged object, wherein a first inner wall is formed by the support insert and the second outer wall is formed by the outer box. Thereby, even if the outer box is destroyed by an external application of force, the support insert still offers protection for the packaged object. In this respect, the claimed packaging offers considerably increased safety for the packaged object with regard to vibrations or applications of force from all directions at limited additional costs compared to the pure outer box.

In accordance with a first exemplary embodiment, the padded part can comprise a bottom-side padded part for placing on the bottom of the outer box and/or a top-side padded part for placing on the support insert under the top of the outer box. The provision of only one of the padded parts already offers a certain degree of improvement in the stability of the packaging; however, the use of both the bottom-side and the top-side padded parts in conjunction with the support insert is particularly advantageous. Through such combination, a particularly high degree of rigidity, particularly against shear forces, of the packaging, is achieved.

For the purposes of this description, the term "shear forces" means all external forces acting on the packaging that could lead to deformation, in particular of the outer box.

In accordance with an additional exemplary embodiment of the packaging in, forming dust flaps on the outer box in such a manner that, in the folded-in state, they abut against each other with their opposite end faces is provided. Alternatively—if this is not the case—a spacer is provided for the precise filling of the gap between the opposite end faces of the two dust flaps. This applies equally to bottom-side and/or top-side dust flaps. The specified measures effectively prevent the opposing dust flaps of the outer box from moving towards each other when the appropriate force is applied. This has the advantage of further increasing the inherent stability or stiffness, as the case may be, of the packaging upon the application of force. This is also accompanied by improved protection of the packaged object.

It is advantageous that the specified spacers are formed to bridge the gap between the end faces of the opposing dust flaps on the top-side and/or bottom-side padding part and preferably in one piece with them. This ensures that they cannot be forgotten when assembling the packaging and also eliminates a separate step in the assembly of the packaging, which would otherwise require the insertion of the singular spacers.

The at least one support insert can have a ring design, or it can be provided or formed in the form of a plurality of support inserts that are arranged in sections circumferentially in the interior of the outer box.

The at least one support insert may be arranged in the recess of the padded part and preferably the support insert extends in the gap of the shaped cushioning parts at the side walls of the outer box. For this purpose, the support insert is supported within the recess of the padding part on the inner sides of the molded cushioning parts.

In accordance with an advantageous exemplary embodiment, the outer box and/or the support insert are made of cardboard, preferably corrugated cardboard. When manufactured from corrugated cardboard, the support insert is preferably cut to size in such a manner that the wave fronts of the corrugated cardboard, when inserted in one of the padded parts, run perpendicular to the plane in which the padded part extends.

The padded parts, for example, are made of molded fiber material, preferably from recycled paper.

In addition to the recess for accommodating the packaged object, the padded parts can each have at least one additional supporting surface for the packaged object. This individual adaptation of the padding part to the packaged object provides further support for the packaged object and stabilizes it within the packaging. Preferably, the bottom-side and top-side padded parts are formed to be identical in construction, which means a significant cost advantage.

The height of the support insert is designed according to the difference between the inner height of the outer box and the sum of the thicknesses of the two padded parts in the area of its recess. If the support insert is not supported on the bottom of the recesses of the padding parts, but, for example, on the packaged object, a contact height must still be taken into account. In any case, it must be ensured that the total height of all parts of the packaging, which are installed in the outer box in a manner arranged one above the other, corresponds to the internal height of the outer box. This is important so that the packaged object is stored inside the outer box without clearance.

Finally, the bottom-side and the top-side padded parts can each be formed in one or more parts.

The aforementioned object of the disclosure is further achieved by a method for packaging the object with the described packaging. The advantages of such method correspond to the advantages specified above in relation to the claimed packaging.

DETAILED DESCRIPTION

The invention is described in detail below with reference to the specified figures in the form of exemplary embodiments. In all figures, the same technical elements are marked with the same reference signs.

Figure 1:
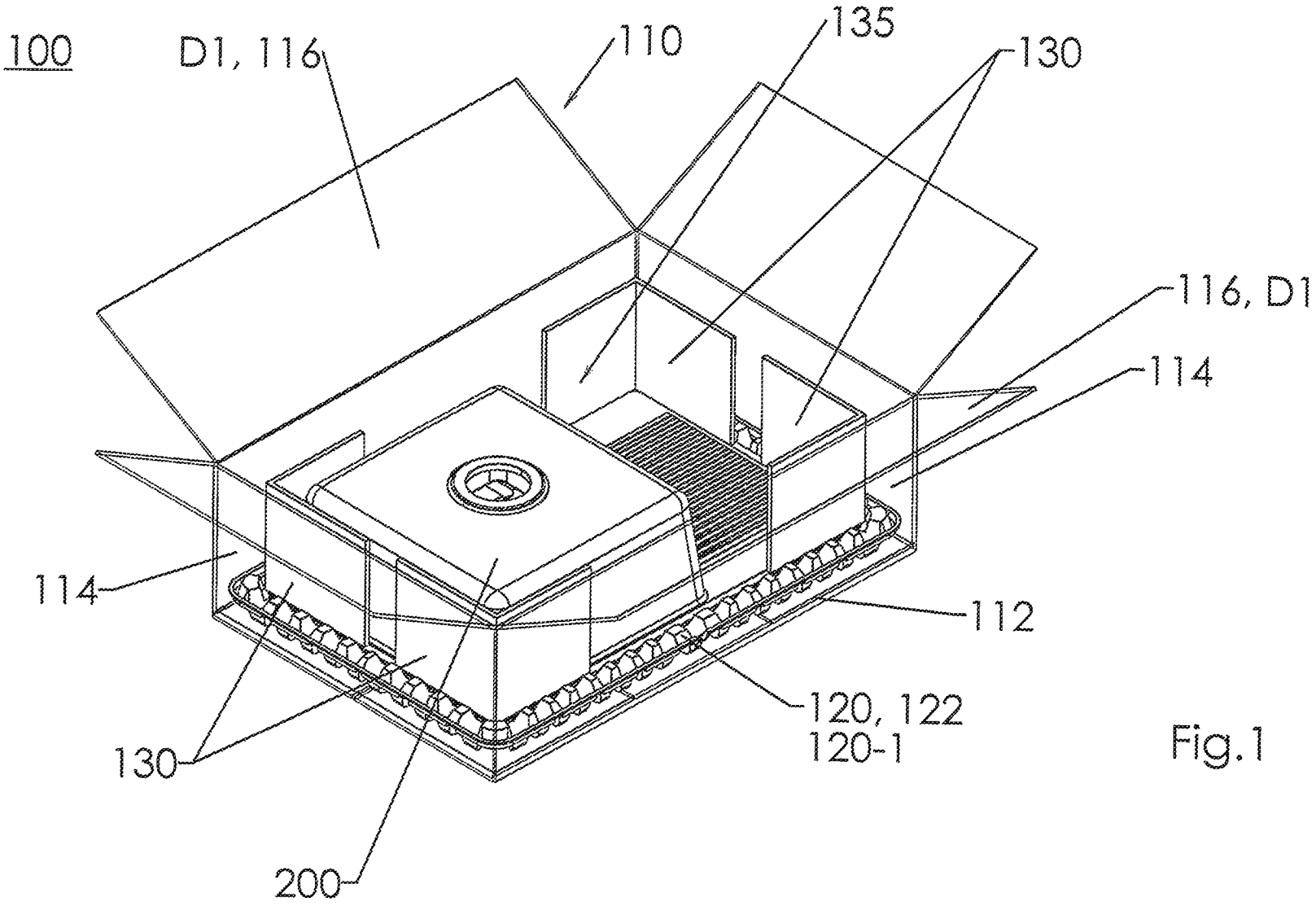
FIG. 1 shows the packaging in an opened state.
Figure 2:
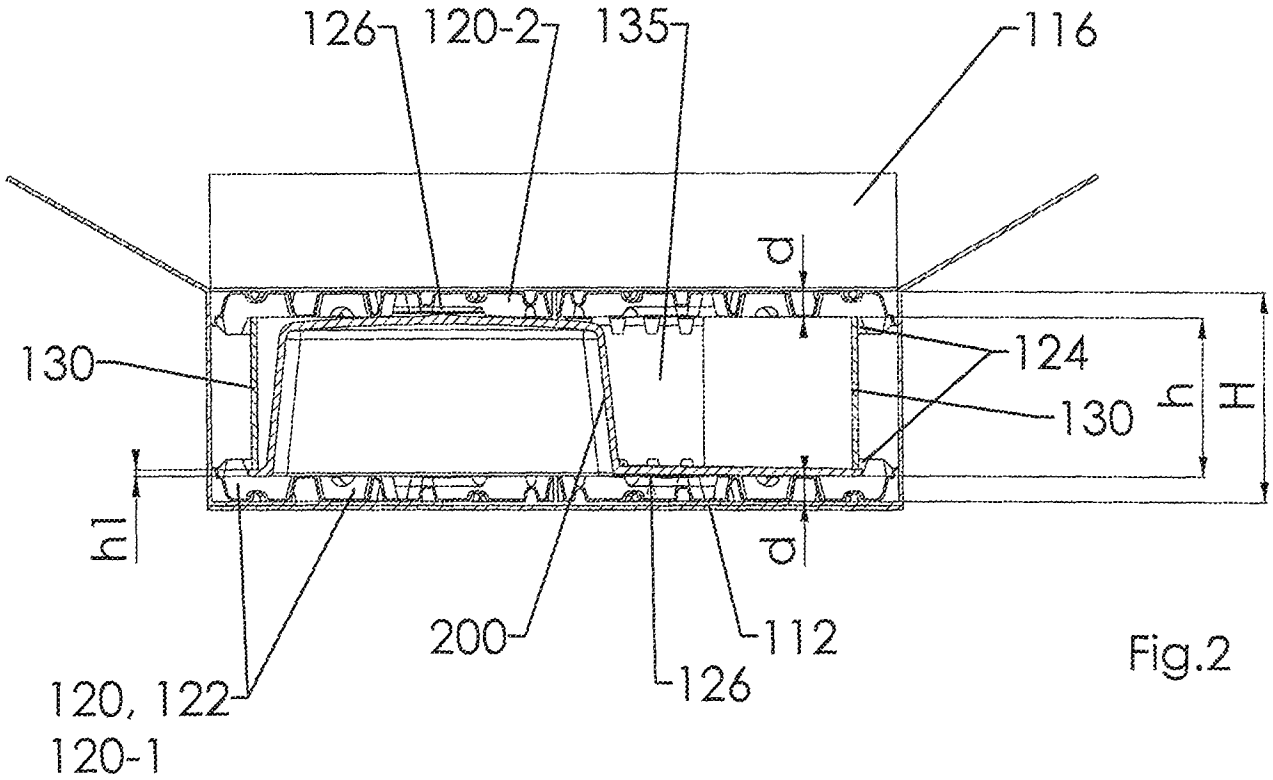
FIG. 2 shows the packaging in a cross-sectional view.

FIGS. 1 and 2 show the packaging 100 for a packaged object 200. The packaging 100 initially comprises a sealable outer box 110 having a bottom 112, with side walls 114 and a top 116. The top 116 may, for example, consist of two top flaps D1. The packaging 100 provides for at least one padded part 120 to be inserted into the interior of the outer box. The padded part has shaped cushioning parts 122 on its periphery for supporting the padded part on the inside against the side walls 114 of the outer box 110 so as to be secured against displacement. A recess 124 is provided within the padding part 120 for the precisely fitting accommodation of the packaged object 200. Furthermore, the packaging comprises a support insert 130 that, together with the padded part 120, spans a packaging space 135 for the packaged object within the outer box. The support insert 130 extends at a distance from the side walls 114 of the outer box and forms at least part of a side wall of the packaging space. As shown in FIG. 2, preferably both a bottom-side padded part 120-1 is provided to be placed on the bottom 112 of the outer box and a top-side padded part 120-2 is provided to be placed on the support insert under the top 116 of the outer box.

The reference sign 120 designates a padded part in general; if it is necessary to distinguish between the bottom-side and the top-side padded part, the reference signs 120-1 and 120-2 are used.

The bottom-side and the top-side padding parts 120-1, 120-2 are preferably formed to be identical in construction. The outer box and/or the support insert are preferably made of cardboard, further preferably of corrugated cardboard. The padded part 120, for example, is made of molded fiber material, preferably from recycled paper. FIG. 2 shows that the recess 124 within the padded parts 120 is preferably formed in a manner individually adapted to the packaged object to the extent that the object rests on the padded part or is in direct connection with it not only at the edges, but preferably also on at least one additional supporting surface 126.

For the stability of the packaging, in particular against forces acting from below on the bottom or from above on the top, it is important that all the individual parts installed in the packaging 100 have an overall height in the assembled state that corresponds to the internal height H of the outer box 110. This is the only way to ensure freedom from clearance in the vertical direction. For this purpose, the height h of the support insert 130 is selected so that it corresponds to the difference between the internal height H of the outer box 110 and the sum of the thicknesses d of the two padding parts 120-1, 120-2 in the area of their recess if the support insert is supported in each case on the bottoms of the recesses 124. On the other hand, if the support insert, as shown in FIG. 2 as an example, is not supported directly on the bottom or the base, as the case may be, of the recess 124, but instead, for example, on the object 200 to be packaged, a corresponding contact height h1 must be taken into account and the height h of the support insert 130 must be dimensioned accordingly lower.

Figure 3:
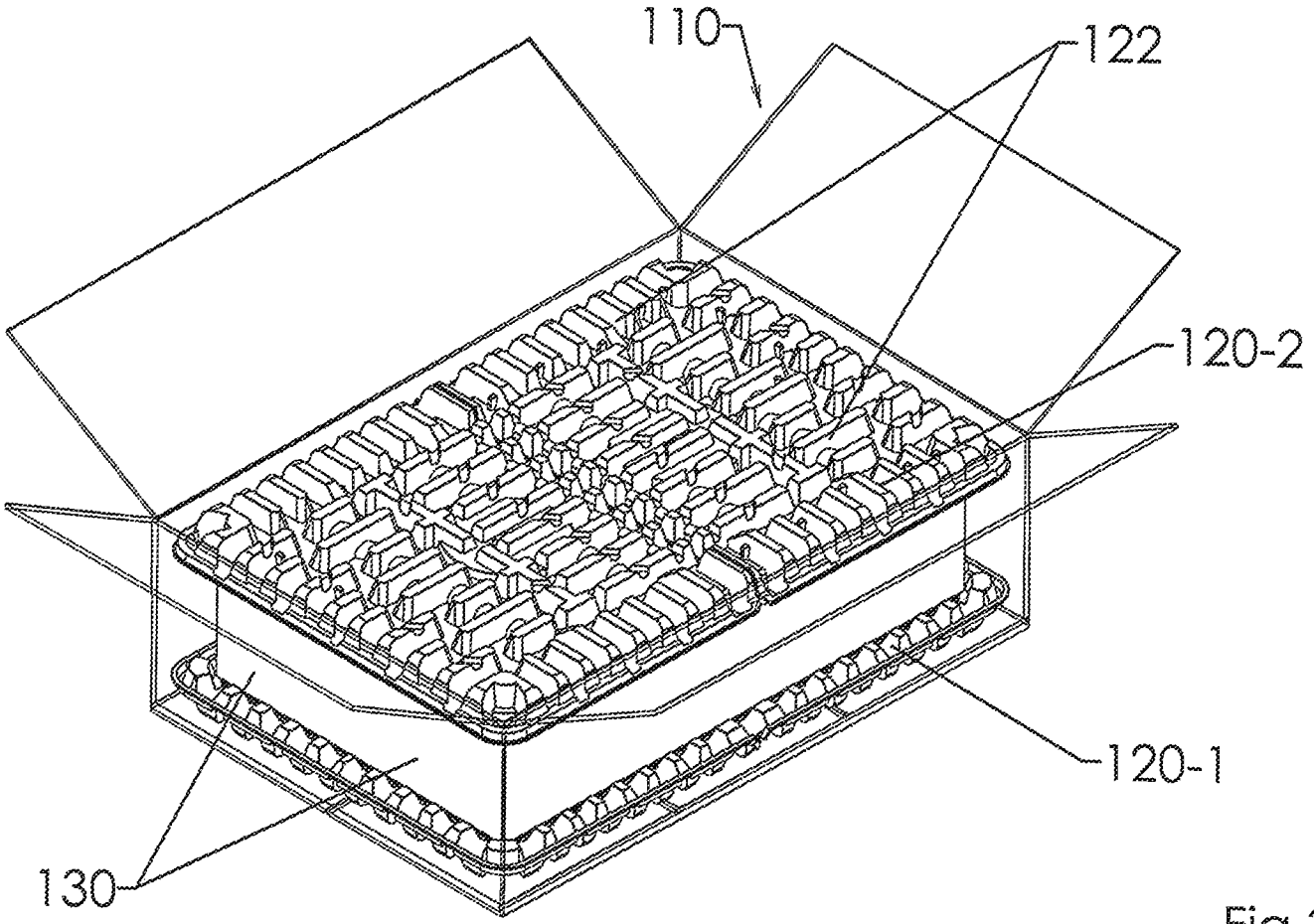
FIG. 3 shows the packaging in a perspective view.

FIG. 3 shows the packaging according to FIG. 2 in perspective view. In particular, it can be seen that both the top-side padded part and the bottom-side padded part can be formed from several parts, in this case, for example, two parts. It can also be seen that the shaped cushioning parts can be formed not only on the periphery, but preferably on the entire outer surface of the padded parts, in order to be able to absorb external applications of force in the form of impacts before they have a damaging effect on the packaged object.

Figure 4:
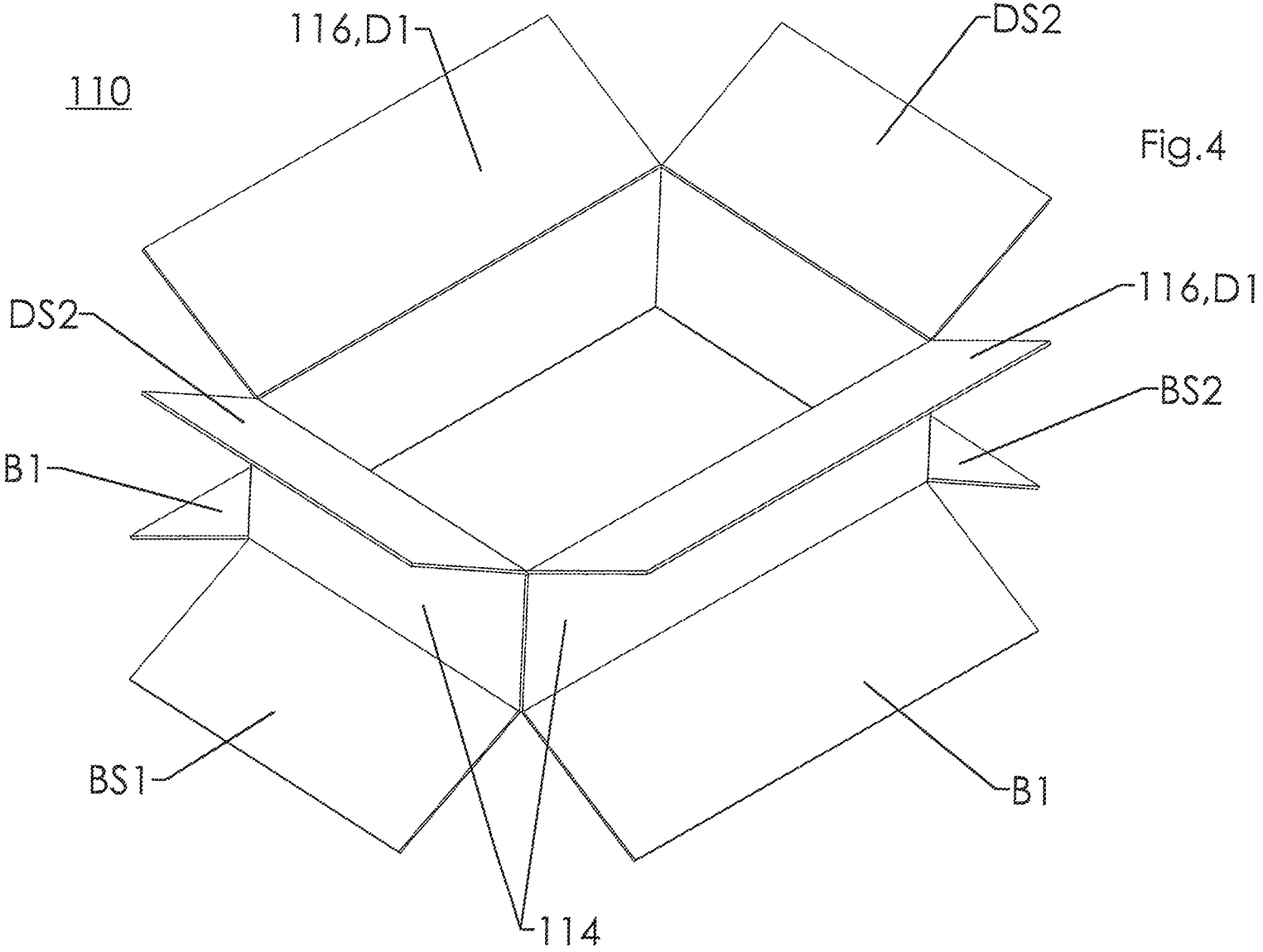
FIG. 4 shows an outer box with its individual elements.

FIG. 4 shows the outer box 110 used for the packaging 100 with all its individual parts.

Figure 5:
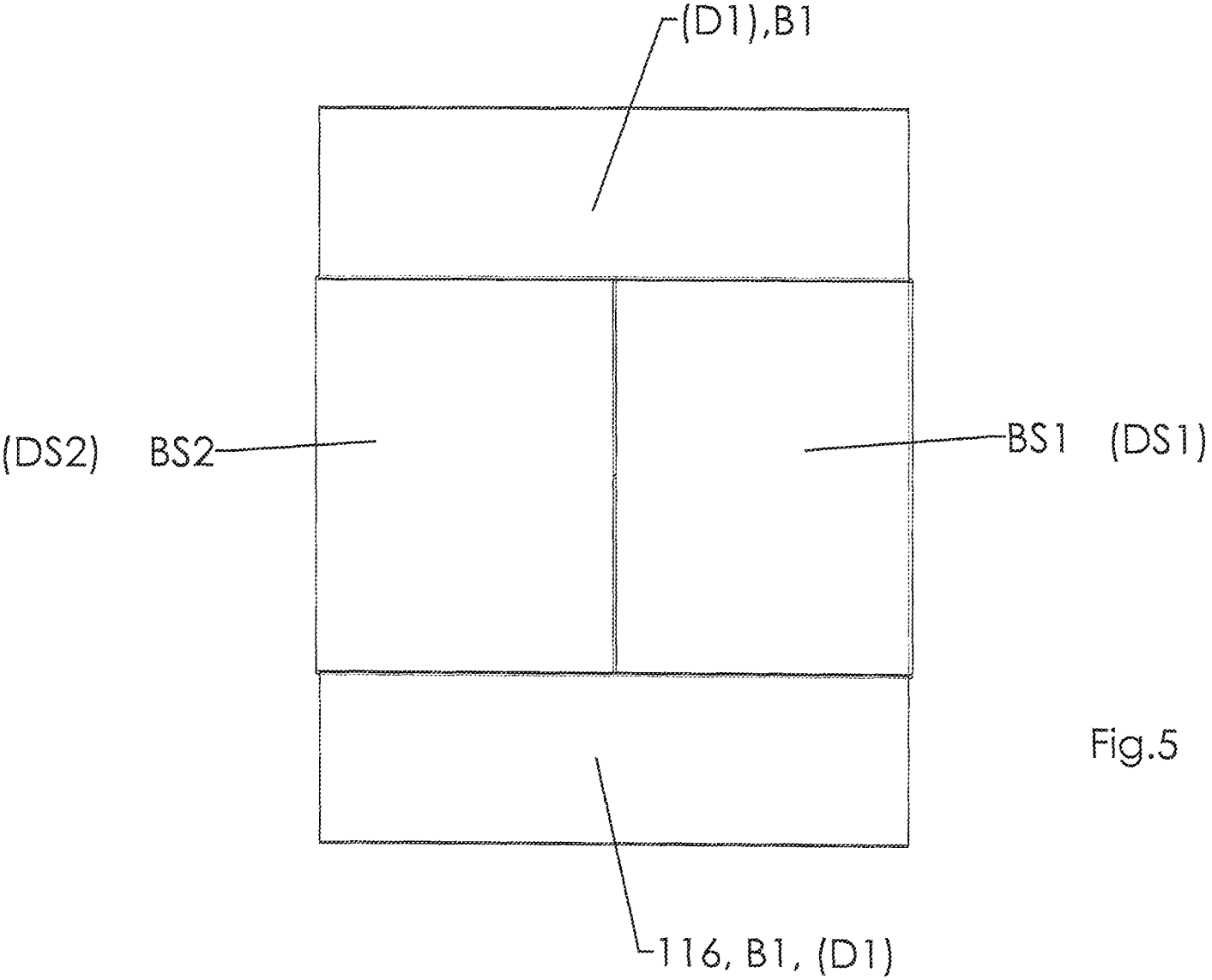
FIG. 5 shows a top view of the bottom or top of the outer box with a formation of the dust flaps in accordance with a first exemplary embodiment.

FIG. 5 shows a top view of the top or the bottom of outer box 110, wherein, in addition to the bottom and lip flaps B1, D1, in particular the bottom-side dust flaps BS1, BS2 and the top-dust flaps DS1, DS2 are shown.

With the exemplary embodiment shown in FIG. 5, the dust flaps are designed in such a manner that they abut against each other flush with their end faces, without any gap.

Figure 6:
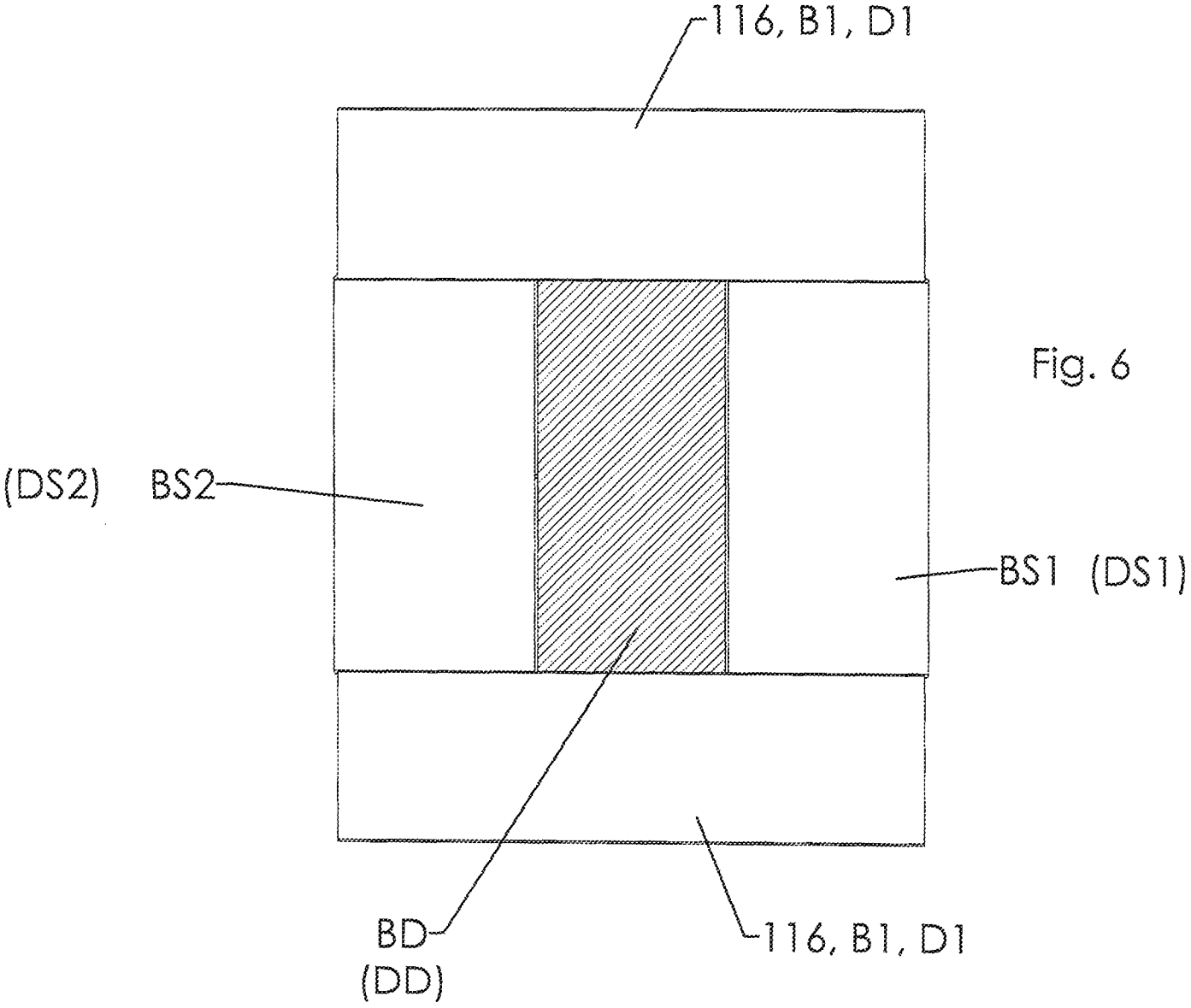
FIG. 6 shows a top view of the bottom or top of the outer box with a formation of the dust flaps in accordance with a second exemplary embodiment.

In contrast, FIG. 6 for this purpose shows a formation of the dust flaps with which they do not abut against each other flush. In accordance with a second exemplary embodiment, the gap between the end faces of the dust flaps is bridged by a bottom-side spacer BD or by a top-side spacer DD. The bridging of any gap between the end faces of the opposing dust flaps ensured by the two exemplary embodiments shown in FIG. 5 and FIG. 6 advantageously results in a significant increase in the inherent stability of the outer box against external applications of force and thus significantly improved protection of the packaged object.

Figure 7:
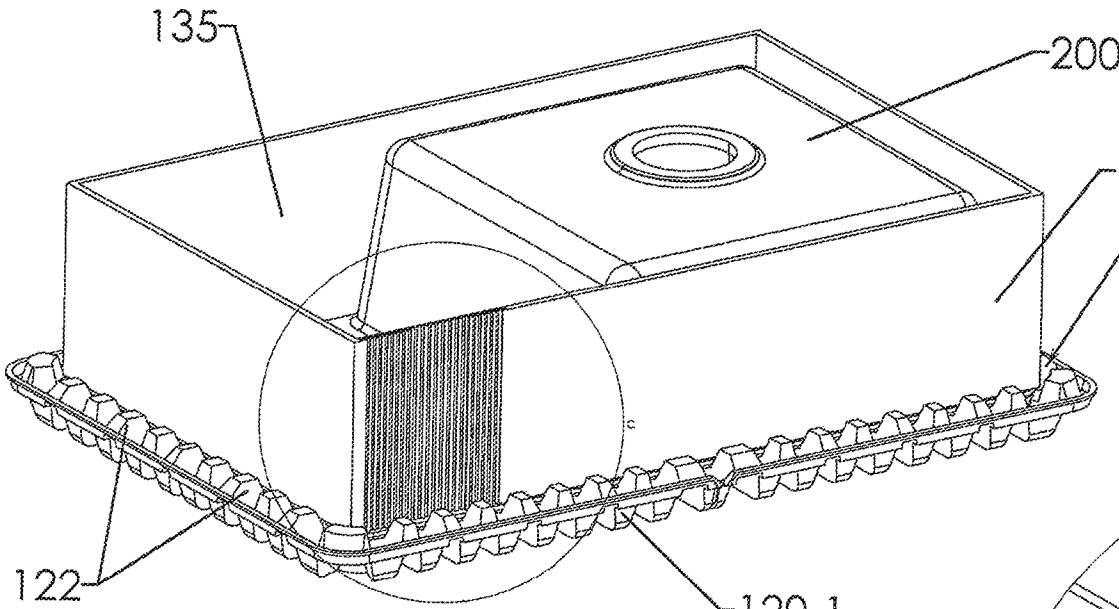
FIG. 7 shows the support insert made of corrugated cardboard.

FIG. 7 shows the support insert 130 inserted into recess 124 of the bottom-side molded part 120-1. This support insert spans the specified packaging space 135, into which the object 200 to be packaged can extend. The shaped cushioning parts 122, which define the gap between the support insert 130 and the side walls 114 of the outer box 110 (not shown in FIG. 7), are also clearly visible. In accordance with the exemplary embodiment in FIG. 7, the support insert 130 is of closed ring design. FIG. 1 shows the support insert in an alternative less stable embodiment in the form of a plurality of smaller support inserts, which are only arranged in sections circumferentially in the interior of the outer box.

Figure 8:
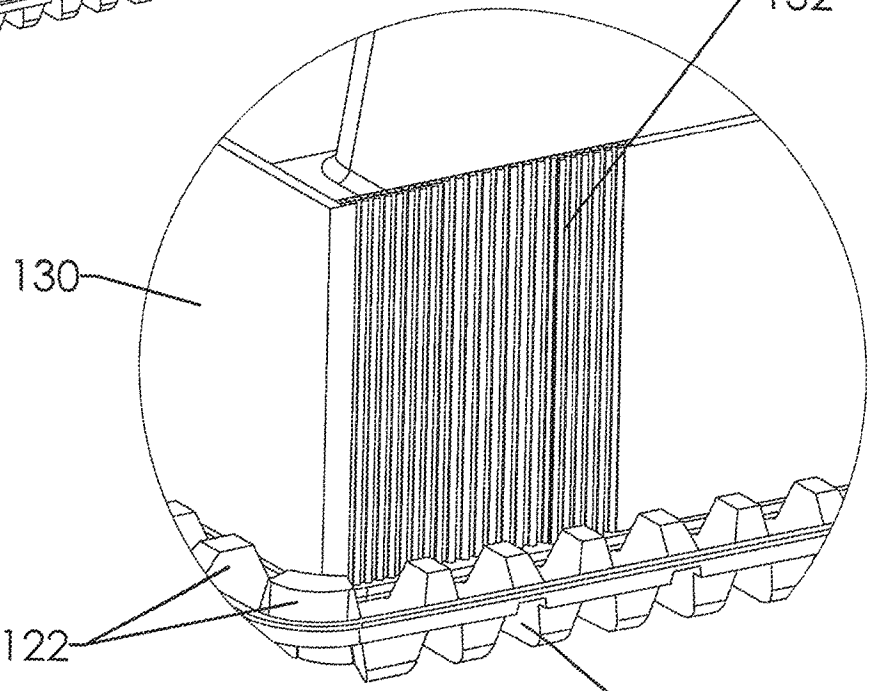
FIG. 8 shows a detailed view of the support insert.

FIG. 8 shows a detailed section of FIG. 7, where the design of the support insert in the form of corrugated cardboard is shown in detail. In particular, it can be seen that the wave fronts 132 of the corrugated cardboard run in a direction perpendicular to the plane in which the padding extends. Such design of the wave fronts 132 offers the advantage of significantly improved stability of the entire packaging upon the application of force in the direction of the longitudinal axis of the wave fronts.

The method for packaging the object 200 comprises the following steps:

- Assembly of the outer box through a rectangular-shaped arrangement and setting up of its side walls and insertion of the bottom flap;
- Insertion of the bottom-side padded part inside the outer box on its bottom, wherein the shaped cushioning parts of the bottom-side padded part are supported internally against the side walls of the outer box;
- Insertion of the packaged object into a recess in the bottom-side padding part;
- Insertion of the at least one support insert into the recess in the bottom-side padded part, in such a manner that the support insert together with the padded part spans a packaging space for the packaged object and encloses it;
- Optional attachment of a top-side padded part with its recess on the side of the at least one support insert turned away from the bottom and, if necessary, also on the packaged object; and
- Closing of the top flap.

The method may be executed in any sequence. That is, the steps need not be executed in the same order as shown above.

When assembling the outer box or when closing it, care must be taken to ensure that the bottom-side and/or top-side dust flaps, if present, are folded in and, after folding in, either abut against each other at their end faces or that a gap between these end faces of the dust flaps is bridged by a spacer 150. If the spacer 150 is molded onto the bottom-side and/or top-side padding part 120-1, 120-2, a separate method step for inserting the spacer as a single part is advantageously not necessary. Rather, the insertion of the spacer is then implemented simultaneously with the insertion of the padding parts.

LIST OF REFERENCE SIGNS

100 Packaging
110 Outer box
112 Bottom of the outer box
114 Side walls of the outer box
116 Top of the outer box
120 Padded part
1201 Bottom-side padding part
120-2 Top-side padding part
122 Shaped cushioning part
124 Recess in the padded part
126 Additional supporting surface
130 Support insert
132 Wave fronts of corrugated cardboard
135 Packaging space
150 Spacer
200 Object
B1 Bottom flap
BS1, BS2 Bottom-side dust flaps
BD Bottom-side spacer
D1 Top flap
DS1, DS2 Top-side dust flaps
DD Top-side spacer
H Inner height of the outer box
h Height of the support insert
h1 Contact height

What is claimed is:

1. A packaging (100), comprising:

a packaged object (200);

an outer box (110) having a bottom (112), side walls (114), and a top (116);

a padded part (120) for insertion into an interior of the outer box (110), the padded part having shaped cushioning parts (122) on a periphery of the padded part (120) for supporting the padded part against the side walls (114) inside of the outer box (110) so as to be secured against displacement, and a recess (124) for precisely fitting accommodation of the packaged object (200); and a support insert (130) arranged in the recess of the padded part that, together with the padded part (120), defines a packaging space (135) for the packaged object within the outer box, wherein the support insert (130) extends at a distance from the side walls (114) of the outer box (110) and forms at least part of a side wall of the packaging space, and wherein a height (h) of the support insert (130) is less than a difference between an inner height (H) of the outer box (110) and a thickness (d) of the padded part (120) in an area of the recess, and wherein the support insert (130) is placed onto the packaged object (200) opposite the padded part (120).

2. The packaging (100) according to claim 1, wherein the padded part (120) is formed as a bottom-side padded part (120-1) for placing on the bottom (112) of the outer box (110) and wherein the packaging further comprises a top-side padded part (120-2) for placing on the support insert (130) under the top (116) of the outer box.

3. The packaging (100) according to claim 2, wherein the bottom (112) of the outer box (110) has at least one bottom flap (B1) for closing the outer box at the bottom, and wherein the top (116) of the outer box (110) has at least one top flap (D1) for closing the outer box at the top.

4. The packaging (100) according to claim 3, wherein the bottom (112) of the outer box (110) has at least two bottom-side dust flaps (BS1, BS2) that, in an assembled state of the outer box, are arranged further inside the outer box and which are located with their end faces opposite one another; and wherein the bottom-side dust flaps are formed in such a manner that they abut against each other with their opposite end faces; or wherein—if the bottom-side dust flaps are formed to be shortened in such a manner that their opposite end faces have a gap to one another—a bottom-side spacer (BD) is provided for precisely filling of the gap between the opposite end faces of the two bottom-side dust flaps (BS1, BS2);

and wherein the top (116) of the outer box (110) has at least two top-side dust flaps (DS1, DS2) that, in the assembled state of the outer box, are arranged further inside the outer box and lie opposite one another with their end faces; and wherein the top-side dust flaps (DS1, DS2) are formed in such a manner that they abut against each other with their opposite end faces; or in that—if the top-side dust flaps are formed to be shortened in such a manner that their opposite end faces have a gap to one another—a top-side spacer (DD) is provided for precisely filling of the gap between the opposite end faces of the two top-side dust flaps (DS1, DS2).

5. The packaging (100) according to claim 3, wherein the bottom (112) of the outer box (110) has at least two bottom-side dust flaps (BS1, BS2) that, in an assembled state of the outer box, are arranged further inside the outer box and which are located with their end faces opposite one another, wherein the bottom-side dust flaps are formed to be shortened in such a manner that their opposite end faces have a gap to one another and a bottom-side spacer (BD) is provided for precisely filling the gap between the opposite end faces of the two bottom-side dust flaps (BS1, BS2), and wherein the bottom-side spacer (BD) is formed on the bottom-side padded part (120-1).

6. The packaging (100) according to claim 3, wherein the top (116) of the outer box (110) has at least two top-side dust flaps (DS1, DS2) that, in an assembled state of the outer box, are arranged further inside the outer box and lie opposite one another with their end faces, wherein the top-side dust flaps (DS1, DS2) are formed to be shortened in such a manner that their opposite end faces have a gap to one another and a top-side spacer (DD) is provided for precisely filling the gap between the opposite end faces of the two top-side dust flaps (DS1, DS2), and wherein the top-side spacer (DD) is formed on the top-side padded part (120-2).

7. The packaging (100) according to claim 2, wherein the bottom-side padded part (120-1) and the top-side padded part (120-2) each have, in addition to the recess (124) for accommodating the packaged object (200), at least one additional supporting surface (126) for the packaged object.

8. The packaging (100) according to claim 2, wherein the bottom-side padded part (120-1) and the top-side padded part (120-2) are formed to be identical in construction.

9. The packaging (100) according to claim 2, wherein the bottom-side padded part (120-1) or the top-side padded part (120-2) are each formed in one or more parts.

10. The packaging (100) according to claim 1, wherein the support insert (130) has a ring design; or wherein a plurality of support inserts (130), which are arranged in sections circumferentially in the interior of the outer box (110), is provided.

11. The packaging (100) according to claim 1, wherein the support insert (130) is arranged at a distance from the side walls (114) of the outer box (110) spaced by the shaped cushioning parts (122).

12. The packaging (100) according to claim 1, wherein the outer box (110) alone, the support insert (130) alone, or both the outer box (110) and the support insert (130) are made of corrugated cardboard.

13. The packaging (100) according to claim 1, wherein the outer box (110) and the support insert (130) are made of corrugated cardboard, and wherein the support insert (130) is cut to size and inserted into the outer box (110) in such a manner that wave fronts (132) of the corrugated cardboard, when inserted into the padded part (120), run perpendicular to a plane (132) in which the padded part extends.

14. The packaging (100) according to claim 1, wherein the padded part (120) is made of molded fiber material.

15. A method for packaging an object (200), comprising:

providing an outer box (110) having a bottom (112) with at least one bottom flap (B1) and at least two bottom-side dust flaps (BS1, BS2), side walls (114), and a top (116) with at least one top flap (D1) and at least two top-side dust flaps (DS1, DS2);

providing a bottom-side padded part (120-1) and a top-side padded part (120-2), the bottom-side padded part and the top-side padded part each having shaped cushioning parts (122) on a periphery of the padded part (120) and a recess (124) for precisely fitting accommodation of the object (200);

providing a support insert (130) arranged in the recess of the padded part that, together with the padded part (120), defines a packaging space (135) for the object within the outer box, wherein the support insert (130) extends at a distance from the side walls (114) of the outer box (110) and forms at least part of a side wall of the packaging space, and wherein a height (h) of the support insert (130) is less than a difference between an inner height (H) of the outer box (110) and a thickness (d) of the padded part (120) in an area of the recess;

assembling the outer box (110) through a rectangular-shaped arrangement and setting up of its side walls (114) and insertion of the bottom flap (B1);

inserting the bottom-side padded part (120-1) inside the bottom of the outer box (110) (112), wherein the shaped cushioning parts (122) of the bottom-side padded part are supported against the side walls (114) inside of the outer box (110);

inserting the object (200) into a recess (124) in the bottom-side padded part;

inserting the support insert (130) onto the object (200) opposite the padded part (120) into the recess (124) in the bottom-side padded part (120-1) in such a manner that the support insert (130) together with the bottom-side padded part (120-1) spans a packaging space (135) for the object (200) and encloses it at least in sections;

inserting the top-side padded part; and closing the top flap (D1).

16. The method according to claim 15, wherein, assembling the outer box (110), prior to inserting the bottom flap (B1), bottom-side standing flaps (BS1, BS2) of the outer box are folded into an opposite position;

or wherein, prior to closing the top (116) of the outer box (110), top-side dust flaps (DS1, DS2) of the outer box (110) are folded into an opposite position.

17. The method according to claim 16, wherein the bottom-side dust flaps (DS1) or top-side dust flaps (DS2) abut against each other on their end faces after folding in.

18. The method according to claim 16, wherein the bottom-side dust flaps (DS1) or the top-side dust flaps (DS2) are located opposite one another in a spaced-apart manner on their end faces after folding in; and wherein a spacer (150) is inserted between the opposite end faces on the bottom-side dust flaps (DS1) or the top-side dust flaps (DS2).

19. The method according to claim 18, wherein the spacer (150) is formed on the bottom-side padded part or the top-side padded part (120-1, 120-2) and, with inserting the padded part, is placed at a position of an intermediate space between the opposite end faces.

20. The method according to claim 15, wherein the object is a component made of a composite material.

* * * * *